US007210756B2

(12) United States Patent
Imai

(10) Patent No.: US 7,210,756 B2
(45) Date of Patent: May 1, 2007

(54) DRIVING APPARATUS FOR RECORDING HEAD AND IMAGE RECORDING APPARATUS INCLUDING THE DRIVING APPARATUS

(75) Inventor: Koji Imai, Inuyama (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 254 days.

(21) Appl. No.: 10/821,901

(22) Filed: Apr. 9, 2004

(65) Prior Publication Data

US 2004/0201638 A1 Oct. 14, 2004

(30) Foreign Application Priority Data

Apr. 9, 2003 (JP) ..... 2003-104806

(51) Int. Cl.
*B41J 29/38* (2006.01)

(52) U.S. Cl. ..... 347/10; 347/11

(58) Field of Classification Search ..... 347/5, 347/9, 11, 10

See application file for complete search history.

(56) References Cited

U.S. PATENT DOCUMENTS 6,280,012 B1 8/2001 Schloeman et al.
6,318,828 B1 * 11/2001 Barbour et al. ..... 347/9
6,375,295 B1 4/2002 Ghozeil et al.
6,698,858 B1 * 3/2004 Askeland et al. ..... 347/12
6,726,300 B2 * 4/2004 Schloeman et al. ..... 347/12
6,932,452 B2 * 8/2005 Nou ..... 347/10

FOREIGN PATENT DOCUMENTS

JP 5-138900 6/1993
JP 2000-158643 6/2000

* cited by examiner

*Primary Examiner*—Stephen Meier
*Assistant Examiner*—Shelby Fidler
(74) *Attorney, Agent, or Firm*—Reed Smith LLP

(57) ABSTRACT

A driving apparatus for at least one recording head comprises a first waveform signal receiver, a first drive signal provider, a first delay circuit, and a second drive signal provider. The first waveform signal receiver receives, through signal lines, a plurality of waveform signals representing various recording modes. The first drive signal provider generates drive signals on the basis of the plurality of waveform signals received by the first waveform signal receiver, and supplies the drive signals to one of recording element groups included in the at least one recording head. The first delay circuit delays the waveform signals received by the first waveform signal receiver. The second drive signal provider generates drive signals on the basis of the waveform signals delayed by the first delay circuit, and supplies the drive signals to another recording element group.

11 Claims, 10 Drawing Sheets

FIG. 2

| WAVEFORM SIGNAL (three types) | number of pulses | number of ink ejections | total quantity of dropped ink |
|---|---|---|---|
| ---- | 0 | 0 | none |
| WAVE 0_1 | 1 | 1 | small |
| WAVE 0_2 | 2 | 2 | medium |
| WAVE 0_3 | 3 | 3 | large |

FIG. 8

| input signal | | DCLK | output signal | | | degree of delay |
|---|---|---|---|---|---|---|
| nA/B | TAP | | Y0 | Y1 | Y2 | |
| 0 | 0 or 1 | ——— | A0 | A1 | A2 | 0 |
| 1 | 0 | ↑ | B0 | B1 | B2 | 2 |
| 1 | 1 | ↑ | B0 | B1 | B2 | 4 |

DRIVING APPARATUS FOR RECORDING HEAD AND IMAGE RECORDING APPARATUS INCLUDING THE DRIVING APPARATUS

BACKGROUND OF THE INVENTION

1. Field of the Invention

The present invention relates to a driving apparatus for a recording head or beads capable of ejecting inks of different colors, applicable to a color inkjet printer or the like, and also relates to an image recording apparatus including the driving apparatus.

2. Description of Related Art

Color inkjet printers are generally classified into two types. The first type has a single recording head including nozzle rows corresponding to the respective colors, for example, four colors of yellow (Y), magenta (M), cyan (C), and black (B). The second type has recording heads corresponding to the respective colors. Actuators are provided so as to correspond to the respective nozzles. Inks are ejected through nozzles by driving the corresponding actuators.

In printers of the above constructions, if a large number of actuators corresponding to the respective nozzles are driven at the same time, there may arise a problem of overcurrent or crosstalk. To relieve the problem, JP-A-5-138900 discloses a technique in which timings for supplying drive signals to actuators are staggered little by little. More specifically, a timing generator block generates waveform signals in which timings of rising edges of pulses are staggered from one another. Each recording head selects one of the waveform signals to be used as a drive signal for the actuators of the recording head. In this manner, the actuators of each recording head can be driven at timings different from the actuators of the other recording heads. The above problem can be relieved thus.

On the other hand, in recent years, for tone control and hysteresis control, a technique is adopted in which waveform signals different from one another in shape for one dot are selectively used as actuator driving signals, as disclosed in JP-A-2000-158643. The hysteresis control is for relieving a problem in which vibration upon driving an actuator remains to affect the later driving operation. More specifically, a waveform signal to be used to form a present dot is selected depending on the absence or presence of a dot immediately before and/or after the present dot. In this technique, the waveform signals for forming one dot differ from each another in the number of pulses, pulse width, pulse height, and the like. For example, the various numbers of pulses for one dot can vary the number of ink ejections for one dot and therefore the total quantity of dropped ink for one dot. This can realize tone control. On the other hand, the various widths of pulse to form one dot, for example, can realize hysteresis control.

In the former of the above-described two techniques, waveform signals generated in the timing generator block are identical in the number of pulses for one dot, and pulse width, and pulse height. The waveform signals differ from one another only in timing of rising edge of pulse. In the former technique, therefore, tone control and hysteresis control are impossible.

In the latter of the above-described two techniques, waveform signals are repeatedly output at constant intervals and the waveform signals themselves are used as timing signals for driving actuators. Therefore, if this technique is applied to a color printer and each color recording head is intended to be time-divisionally driven like the former technique, the waveform signals must be supplied to each recording head. As a result, a great number of signal lines are required between the recording heads and the printed circuit board in the printer body. This brings about a problem of difficulty of routing of the signal lines. In addition, there may arise problems of increasing the manufacturing cost of the printer and complicating the construction.

SUMMARY OF THE INVENTION

An object of the present invention is to provide a driving apparatus for a recording head or heads in which the number of signal lines between each recording head and a printed circuit board in the machine body can be decreased, and also to provide an image recording apparatus including the driving apparatus.

According to an aspect of the present invention, a driving apparatus for at least one recording head comprises a first waveform signal receiver that receives, through signal lines, waveform signals representing various recording modes, a first drive signal provider that generates drive signals on the basis of the waveform signals received by the first waveform signal receiver, and supplies the drive signals to one of recording element groups included in the at least one recording head, a first delay circuit that delays the waveform signals received by the first waveform signal receiver, and a second drive signal provider that generates drive signals on the basis of the waveform signals delayed by the first delay circuit, and supplies the drive signals to another recording element group.

According to the invention, the first drive signal provider generates drive signals on the basis of the waveform signals received by the first waveform signal receiver, and supplies the drive signals to one of the recording element groups, and the second drive signal provider generates drive signals on the basis of the waveform signals delayed by the first delay circuit, and supplies the drive signals to another recording element group. Therefore, the number of signal lines between the recording head or heads and the printed circuit board in the machine body can be decreased.

According to another aspect of the present invention, an image recording apparatus comprises a waveform signal generator that generates waveform signals representing various recording modes, at least one recording head including recording element groups, and a driving apparatus that drives the at least one recording head. The driving apparatus comprises a first waveform signal receiver that receives, through signal lines, the waveform signals generated by the waveform signal generator, a first drive signal provider that generates drive signals on the basis of the waveform signals received by the first waveform signal receiver, and supplies the drive signals to one of the recording element groups included in the at least one recording head, a first delay circuit that delays the waveform signals received by the first waveform signal receiver, and a second drive signal provider that generates drive signals on the basis of the waveform signals delayed by the first delay circuit, and supplies the drive signals to another recording element group.

According to the invention, because the driving apparatus can bring about an decrease in the number of signal lines between the recording head or heads and a printed circuit board in the machine body, increase in manufacturing cost of the image recording apparatus and complication of construction of the image recording apparatus can be suppressed;

BRIEF DESCRIPTION OF THE DRAWINGS

Other and further objects, features and advantages of the invention will appear more fully from the following description taken in connection with the accompanying drawings in which:

FIG. 2 shows the number of pulses for one dot, the number of ink ejections for one dot, and the total quantity of dropped ink for one dot, in relation to each of first to third waveform signals generated by a waveform signal generator on a printed circuit board in the printer body of FIG. 1:

FIG. 8 shows logical conditions of outputs of delay circuits in the driver IC of FIG. 7;

DESCRIPTION OF THE PREFERRED EMBODIMENTS

Figure 1:
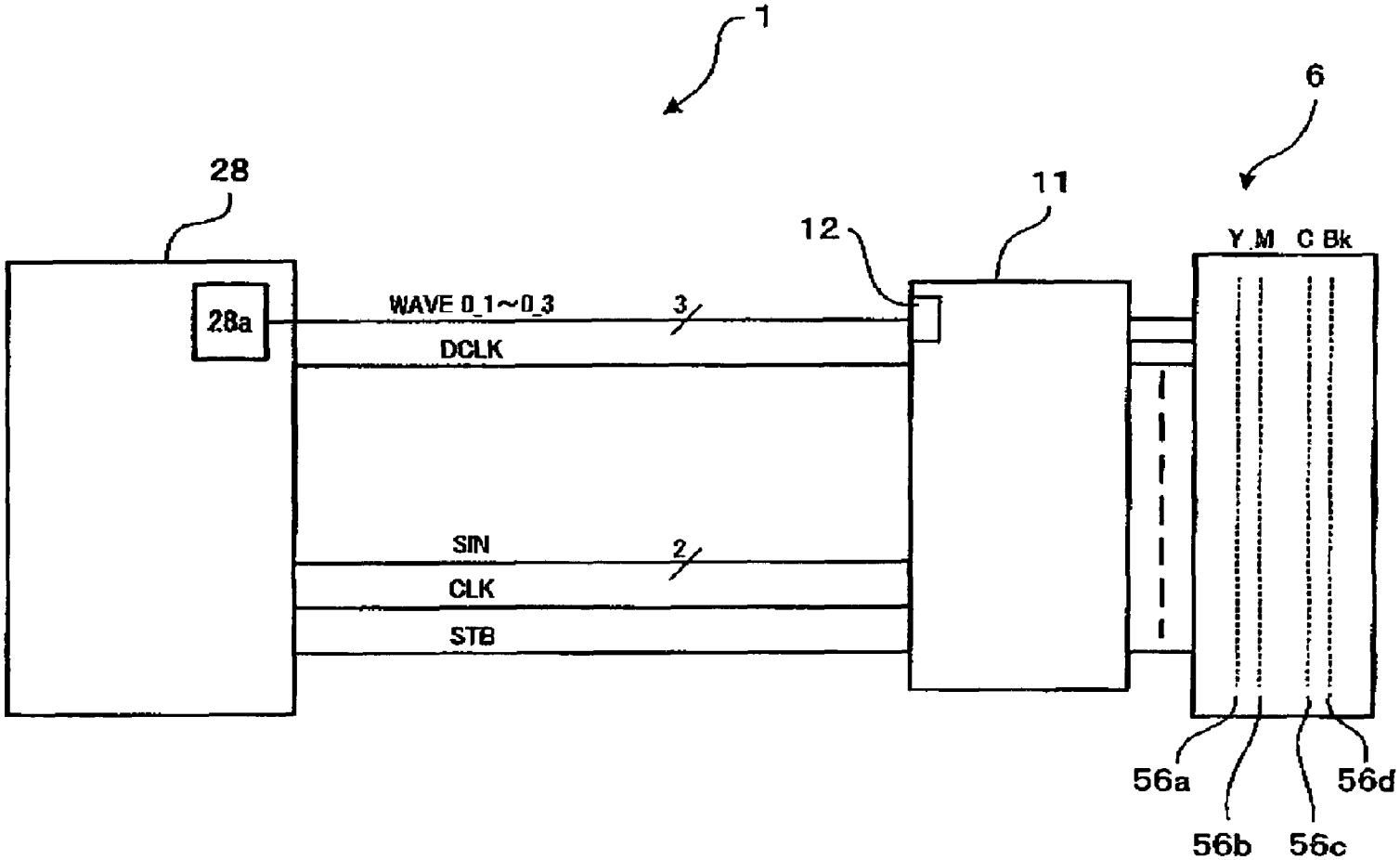
FIG. 1 is a block diagram generally showing an electric construction of a color inkjet printer (image recording apparatus) including therein an driver IC (driving apparatus) for a recording head according to a first embodiment of the present invention.

Hereinafter, preferred embodiments of the present invention will be described with reference to drawings First will be described a color inkjet printer (image recording apparatus) including therein a driver IC (driving apparatus) for a recording head according to a first embodiment of the present invention. The color inkjet printer 1 of this embodiment is a serial printing type, in which a non-illustrated carriage is provided so as to be movable parallel to a record medium such as a paper, and a recording head 6 and a driver IC 11 are mounted on the carriage, as illustrated in FIG. 1. The printer 1 further has a printed circuit board 28 in the printer body at a position where the carriage is to be stopped. As illustrated in FIG. 1, the driver IC 11 is connected to the printed circuit board 28 through a non-illustrated flexible wiring board.

As illustrated in FIG. 1, the recording head 6 has nozzle rows 56*a*, 56*b*, 56*c*, and 56*d* corresponding to the respective colors of yellow (Y), magenta (M), cyan (C), and black (B). An actuator is provided so as to correspond to each of nozzles constituting the nozzle rows 56*a* to 56*d*. When an actuator is driven, ink is ejected through the corresponding nozzle. For example, a piezoelectric element or a vibration plate driven by a heater or static electricity can be used as each actuator.

The whole construction of a nozzle and the corresponding ink passage and actuator of this embodiment corresponds to a "recording element" of the present invention. In this embodiment, recording elements are classified into groups corresponding to the respective colors.

The printed circuit board 28 includes therein a waveform signal generator 28*a* for generating three waveform signals WAVE0_1, WAVE0_2, and WAVE0_3 different in shape from one another. As shown in the upper portion of FIG. 6, these waveform signals differ from one another in the number of pulses, that is, the waveform signals WAVE0_1, WAVE0_2, and WAVE0_3 have one, two, and three pulses, respectively. The waveform signals WAVE0_1, WAVE0_2, and WAVE0_3 are referred to as first, second, and third waveform signals, respectively. The number of pulses corresponds to the number of ink ejections through each nozzle. Ink is ejected one time in the case of the first waveform signal WAVE0_1, two times in the case of the second waveform signal WAVE0_2, and three times in the case of the third waveform signal WAVE0_3. Thus, in accordance with the first to third waveform signals WAVE0_1, WAVE0_2, and WAVE0_3, the total quantity of dropped ink for one dot varies to realize tone control. In this embodiment, including the case of no ink ejection, four kinds of total ink quantity for one dot can be obtained. FIG. 2 shows the number of pulses for one dot, the number of ink ejections for one dot, and the total quantity of dropped ink for one dot, in relation to the first to third waveform signals WAVE0_1, WAVE0_2, and WAVE0_3. In FIG. 2, the total quantity of dropped ink is represented by "none" in the case of no ink ejection, "small" in the case of one ink ejection, "medium" in the case of two ink ejections, and "large" in the case of three ink ejections, In this embodiment, "the number of ink ejections for one dot", that is, the tone level of one dot corresponds to the "recording mode" of the present invention.

As illustrated in FIG. 1, the printed circuit board 28 supplies to the driver IC 11 a clock signal DCLK, two-bit image data SIN, a transfer clock CLK, and a strobe control signal STB as well as the first to third waveform signals WAVE0_1, WAVE0_2, and WAVE0_3. Those will be described later in detail.

The electric construction of the driver IC 11 will be described with reference to FIG. 3. In the right portion of the FIG. 3, actuator groups 60*a*, 60*b*, 60*c*, and 60*d* corresponding to the respective nozzle rows 56*a*, 56*b*, 56*c*, and 56*d* are shown in a vertical row.

The driver IC 11 includes therein a waveform signal receiver (first waveform signal receiver) 12*a* for receiving through signal lines the first to third waveform signals WAVE0_1, WAVE0_2, and WAVE0_3 generated by the waveform signal generator 28*a* in the printed circuit board 28 in the printer body. The driver IC 11 further includes therein four shift registers 20, 21, 22, and 23; four delay flip-flops 24, 25, 26, and 27; and first, second, third, and fourth drive signal providers 13, 14, 15, and 16, so as to correspond to the respective colors. The driver IC 11 further includes therein a first delay circuit 17, a second delay circuit 18 connected in series to the first delay circuit 17, and a third delay circuit 19 connected in series to the second delay circuit 18.

Figure 3:
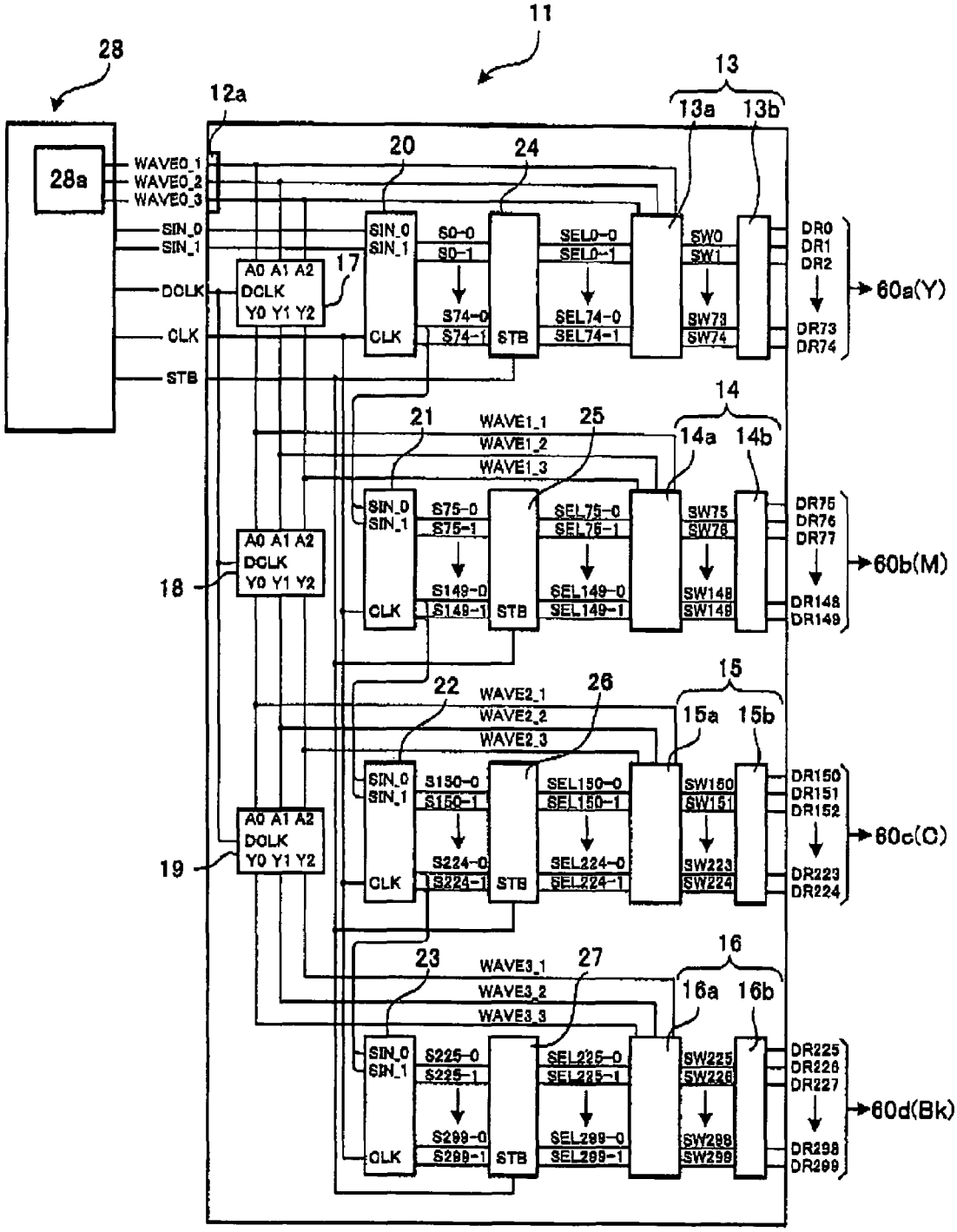
FIG. 3 is a block diagram of the electric construction of the driver IC and printed circuit board of FIG. 1.

To the uppermost shift register 20 of the four shift registers 20 to 23 of FIG. 3, the transfer clock CLK and two-bit image data SIN_0 and SIN_1 are sent from the printed circuit board 28 in the printer body. At this time, the image data SIN_0 and SIN_1 are serially sent synchronously with the transfer clock CLK. Signal lines for the transfer clock CLK are provided in parallel for the four shift registers 20 to 23. Thus, the transfer clock CLK is sent from the printed circuit board 28 in the printer body to three shift registers 21 to 23 as well as the uppermost shift register 20. Because the shift registers 20 to 23 are in cascade connection, the image data SIN_0 and SIN_1 input to the uppermost shift register 20 are sent to the second shift register 21, the third shift register 22, and the fourth shift register 23 in this order.

The bit length L of each shift register 20 to 23 is represented by L=N×P, where N is the number of nozzles included in each nozzle row 56*a* to 56*d* and P is the number of bits of image data. In this embodiment, N=75 and P=2 and therefore L=150. In accordance with rising edges of the transfer clock CLK, each shift register 20 to 23 converts the serially input image data SIN_0 and SIN_1 into parallel image data S*-0 and S*-1 for the nozzles of the corresponding nozzle row 56*a* to 56*d* and then outputs them to the corresponding delay flip-flop 24 to 27. Here, the symbol * represents a number of 0 to 74, 75 to 149, 150 to 224, or 225 to 299 for the seventy-five nozzles included in each nozzle row 56*a* to 56*d*.

Each delay flip-flop 24 to 27 is a latch circuit. In accordance with rising edges of the strobe control signal STB being sent from the printed circuit board 28 in the printer body, each delay flip-flop 24 to 27 outputs as selection signals SEL*-0 and SEL*-1 the image data S*-0 and S*-1 sent from the corresponding shift register 20 to 23. The delay flip-flops 24 to 27 each have the same bit length as the shift registers 20 to 23, The drive signal providers 13, 14, 15, and 16 include multiplexers 13*a*, 14*a*, 15*a*, and 16*a* as waveform selectors, and drive buffers 13*b*, 14*b*, 15*b*, and 16*b*, respectively.

Each multiplexer 13*a* to 16*a* receives three waveform signals directly from the waveform signal receiver 12*a* or through one or ones of the first to third delay circuits 17 to 19, in addition to the selection signals SEL*-0 and SEL*-1 from the corresponding delay flip-flop 24 to 27. The uppermost multiplexer 13*a* of the four multiplexers 13*a* to 1*a* of FIG. 3 receives the waveform signals directly from the waveform signal receiver 12*a*. The other three multiplexers 14*a* to 16*a* receive waveform signals delayed by one or ones of the first to third delay circuits 17 to 19. More specifically, the uppermost multiplexer 13*a* of FIG. 3 receives the first to third waveform signals WAVE0_1, WAVE0_2, and WAVE0_3 generated by the waveform signal generator 28*a* in the printed circuit board 28 in the printer body. The second multiplexer 14*a* receives three waveform signals WAVE1_1, WAVE1_2, and WAVE1_3 obtained by the first delay circuit 17 delaying the above first to third waveform signals WAVE0_1, WAVE0_2, and WAVE0_3. The third multiplexer 15*a* receives three waveform signals WAVE2_1, WAVE2_2, and WAVE2_3 obtained by the second delay circuit 18 further delaying the three waveform signals delayed by the first delay circuit 17. The fourth multiplexer 16*a* receives three waveform signals WAVE3_1, WAVE3_2, and WAVE3_3 obtained by the third delay circuit 19 further delaying the three waveform signals delayed by the second delay circuit 18.

On the basis of the selection signals SEL*-0 and SEL*-1, each multiplexer 13*a* to 16*a* selects one of the three waveform signals WAVEx_1, WAVEx_2, and WAVEx_3, where x=0 for the waveform signals having passed through no delay circuit and x=1 to 3 for the waveform signals having passed through the first to third delay circuits 17 to 19, respectively. Each multiplexer 13*a* to 16*a* then outputs one selection waveform signal SW* for each nozzle of the corresponding nozzle row 56*a* to 56*d*. More specifically, there are four combinations of the selection signals SEL*-0 and SEL*-1 as "0" and "0", "0" and "1", "1" and "0", and "1" and "1". In accordance with the respective cases, each multiplexer 13*a* to 16*a* selects "no ejection" and the waveform signals WAVEx_1, WAVEx_2, and WAVEx_3. Such selection signals SEL*-0 and SEL*-1 are provided for each nozzle. Therefore, the total quantity of dropped ink for one dot can vary from nozzle to nozzle to realize tone control.

Each drive buffer 13*b* to 16*b* generates a drive signal DR of a predetermined voltage to each actuator of the corresponding actuator group 60*a* to 60*d* on the basis of the selection waveform signal SW* output from the corresponding multiplexer 13*a* to 16*a*. Each drive buffer 13*b* to 16*b* then supplies the drive signal DR to each actuator of the corresponding actuator group 60*a* to 60*d*. Thus, actuators of each actuator group 60*a* to 60*d* are driven to eject ink through the corresponding nozzles.

Figure 4:
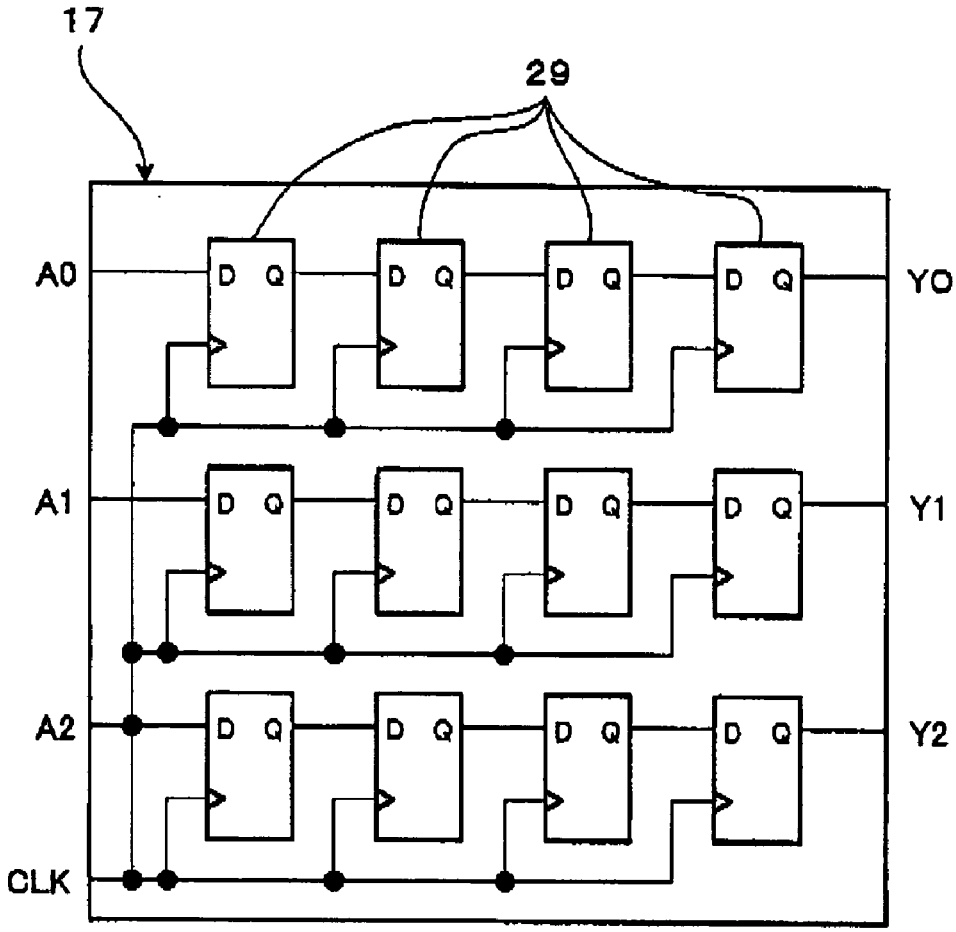
FIG. 4 is a block diagram of the electric construction of a delay circuit in the driver IC of FIG. 3.

The electric construction of the delay circuits 17 to 19 will be described in more detail with reference to FIG. 4. FIG. 4 shows the first delay circuit 17 as a representative. Either of the second and third delay circuits 18 and 19 has the same construction as the first delay circuit 17.

Figure 5:
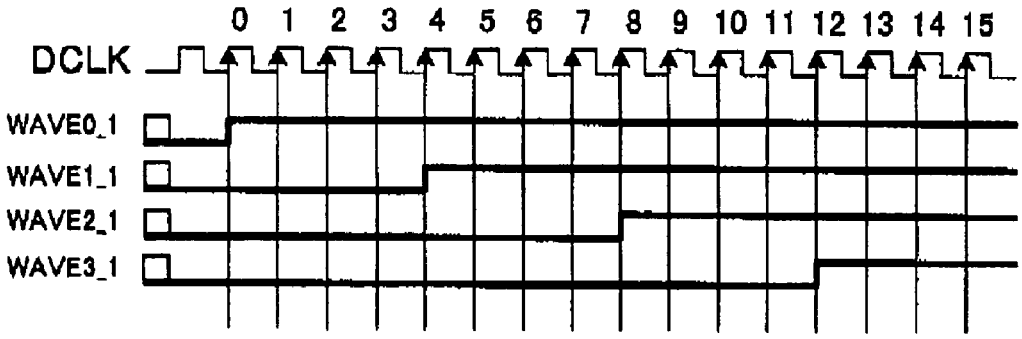
FIG. 5 is a timing chart showing a state wherein the first waveform signal is delayed in order by the delay circuits.

The delay circuit 17 has three input ports A0, A1, and A3 and three output ports Y0, Y1, and Y2. The delay circuit 17 includes four delay flip-flops 29 between each pair of input and output ports. Each delay flip-flop 29 receives the clock signal DCLK being sent from the printed circuit board 28 in the printer body and transfers data from the input (D) side to the output (Q) side in accordance with the rising edge of the clock signal DCLK. In this embodiment, while the rising edge of the clock signal DCLK appears four times, data is transferred from each of the input ports A0, A1, and A2 to the corresponding one of the output ports Y0, Y1, and Y2. FIG. 5 shows a state wherein the first waveform signal WAVE0_1 input to the waveform signal receiver 12*a* is delayed in order by the delay circuits 17 to 19. In FIG. 5, the vertical and horizontal axes represent voltage and time, respectively. Although FIG. 5 shows delay of only the first waveform signal WAVE0_1, the second and third waveform signals WAVE0_2 and WAVE0_3 are delayed likewise.

Figure 6:
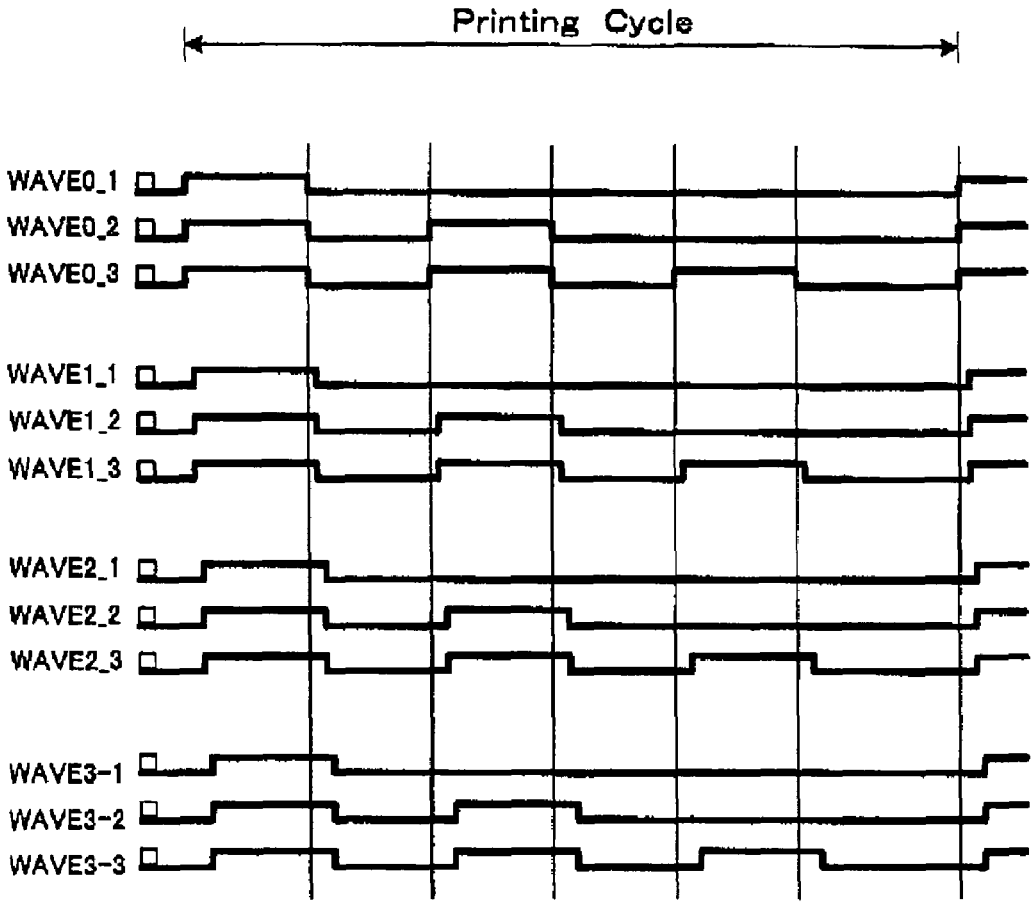
FIG. 6 is a timing chart showing a state wherein the first to third waveform signals are delayed in order by the delay circuits.

FIG. 6 shows a state wherein the first to third waveform signals WAVE0_1, WAVE0_2, and WAVE0_3 are delayed in order by the delay circuits 17 to 19. In FIG. 6, like FIG. 5, the vertical and horizontal axes represent voltage and time, respectively.

As apparent from FIG. 6, any of the first to third waveform signals WAVE0_1, WAVE0_2, and WAVE0_3 is repeatedly generated in constant printing cycles. Therefore, each waveform signal itself can be used as a timing signal for driving actuators and no other timing signal is required. That is, each set of the image data S*-0 and S*-1 having been converted in parallel by the shift registers 20 to 23 is output as drive signals DR* at timings of a selected waveform signal within each printing cycle.

As described above, in the driving apparatus for a recording head, i.e., the driver IC 11, according to the first embodiment of the present invention, each of the first to fourth drive signal providers 13 to 16 generates drive signals DR* on the basis of three waveform signals received by the waveform signal receiver 12*a* or three waveform signals WAVEx_1, WAVEx_2, and WAVEx_3 obtained by delaying the above three waveform signals, and supplies the drive signals DR* to the corresponding one of the actuator groups 60*a* to 60*d*. For example, when the waveform signal generator 28*a* generates three waveform signals for each of four actuator groups 60*a* and 60*d* and sends the waveform signals in parallel, twelve signal lines in total are required between the recording head 6 and the printed circuit board 28 in the printer body. Contrastingly in this embodiment, although four actuator groups exist, only three waveform signals WAVE0_1, WAVE0_2, and WAVE0_3 for one actuator group 60*a* suffice. Therefore, the number of signal lines between the recording head 6 and the printed circuit board 28 in the printer body can be relatively decreased to three.

From the viewpoint of effect to the printer 1, because the number of signal lines between the recording head 6 and the printed circuit board 28 in the printer body can be decreased by using the driver IC 11, increase in manufacturing cost of the printer 1 and complication of construction of the printer 1 can be suppressed.

In addition, because the driver IC 11 of this embodiment includes the delay circuits 17 to 19, the driving timings of the actuator groups 60*a* to 60*d* can be staggered from one another by the time corresponding to the delay quantity. By controlling the delay quantity to an adequate value, the problems of overcurrent and crosstalk can be relieved.

Assuming that the number of actuator groups is N where N is a natural number of three or more (N=4 in this embodiment), the driver IC 11 of this embodiment includes, in addition to the first delay circuit 17, the second to (N−1)th delay circuits (the second and third delay circuits 18 and 19 in this embodiment) connected to the first delay circuit 17 for further delaying the respective waveform signals having been delayed by the first delay circuit 17. Therefore, even when the number of actuator groups is large, because the waveform signals delayed by the delay circuit 17 to 19 can be supplied to each actuator group, the above-described effect of relatively decreasing the number of signal lines can be obtained.

In addition, the second and third delay circuits 18 and 19 are connected to the first delay circuit 17 in series. Therefore, waveform signals obtained by delaying the respective first to third waveform signals WAVE0_1, WAVE0_2, and WAVE0_3 in order can be supplied to each actuator group. Thus, the above-described problems of overcurrent and crosstalk can be relieved more effectively.

In the above-described first embodiment, four flip-flops 29 are provided between each pair of input and output ports of the delay circuit 17 as illustrated in FIG. 4. However, the number of flip-flops 29 is not limited to that. By changing the number of flip-flops 29 provided between each pair of input and output ports, the degree of delay can be controlled to an adequate value.

Next, a driver IC for a recording head (driving apparatus) according to a second embodiment of the present invention will be described with reference to FIG. 7. Hereinafter, the same components as in the first embodiment will be denoted by the same reference numerals as in the first embodiment, thereby omitting the description thereof.

Figure 7:
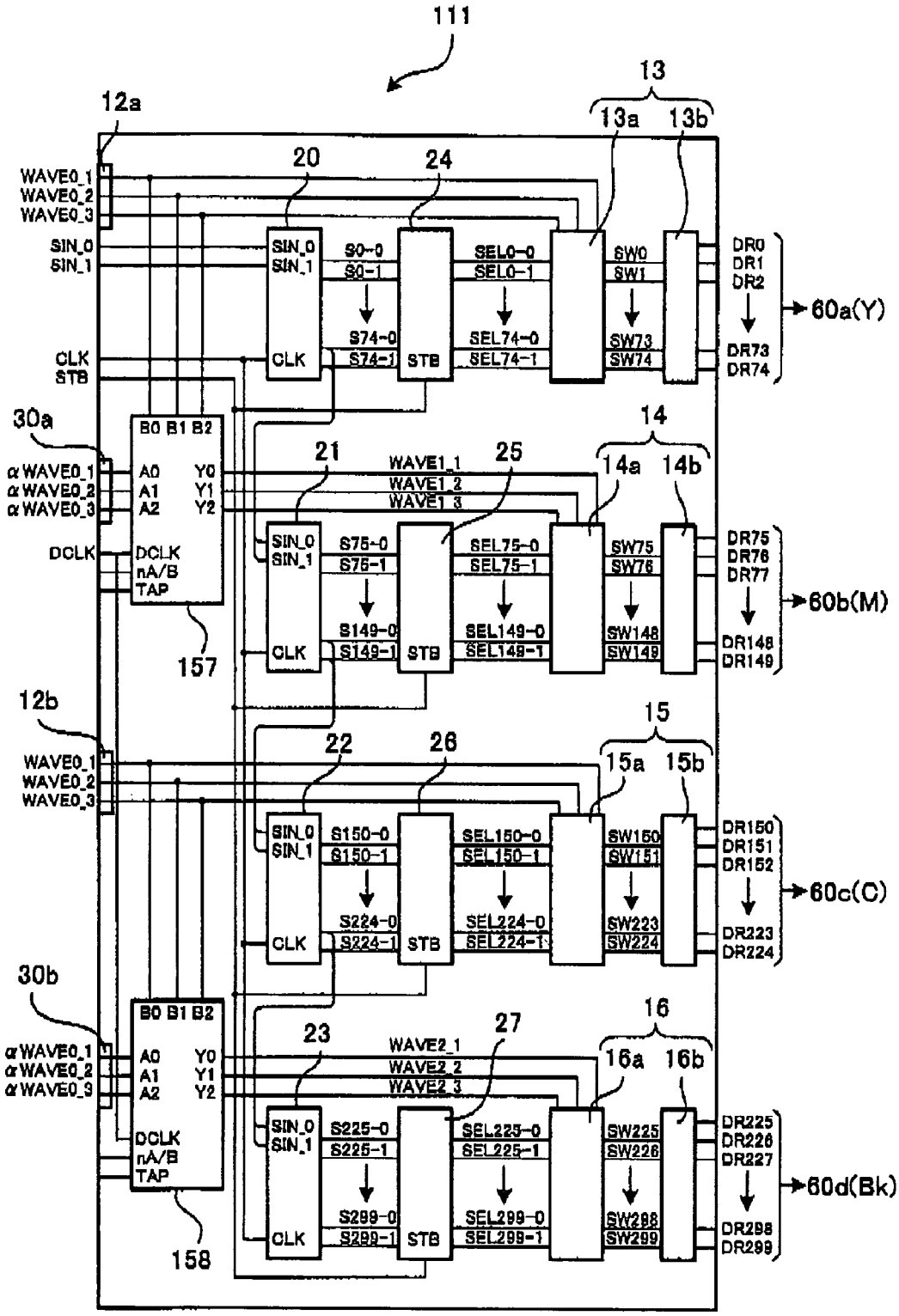
FIG. 7 is a block diagram of the electric construction of a driver IC (driving apparatus) according to a second embodiment of the present invention.

Although the printed circuit board 28 in the printer body is omitted in FIG. 7, the waveform signal generator 28*a* in the printed circuit board 28 as illustrated in FIG. 1 generates, in addition to the three waveform signals WAVE0_1, WAVE0_2, and WAVE0_3 like the first embodiment, further three waveform signals α WAVE0_1, α WAVE0_2, and α WAVE0_3 different in shape from the above waveform signals. That is, when three waveform signals constitute one set, the waveform signal generator 28*a* as illustrated in FIG. 1 generates two sets of waveform signals, i.e., six waveform signals in total.

The driver IC 111 of this embodiment has two first waveform signal receivers 12*a* and 12*b* and two second waveform signal receivers 30*a* and 30*b*. Each of the first waveform signal receivers 12*a* and 12*b* receives one set of waveform signals WAVE0_1, WAVE0_2, and WAVE0_3 generated by the waveform signal generator 28*a*. Each of the second waveform signal receivers 30*a* and 30*b* receives the other set of waveform signals α WAVE0_1, α WAVE0_2, and α WAVE0_3 generated by the waveform signal generator 28*a*. The driver IC 111 includes two delay circuits 157 and 158 different in construction from the delay circuits 17 to 19 of the driver IC 11 of the first embodiment. The first waveform signal receivers 12*a* and 12*b* are connected to multiplexers 13*a* and 15*a* corresponding to yellow (Y) and cyan (C), respectively. The second waveform signal receivers 30*a* and 30*b* are connected to the first and second delay circuits 157 and 158, respectively.

One set of waveform signals WAVE0_1, WAVE0_2, and WAVE0_3 input to the first waveform signal receivers 12*a* and 12*b* are supplied to the multiplexers 13*a* and 15*a* corresponding to yellow (Y) and cyan (C) without passing through any delay circuit. On the other hand, the other set of waveform signals α WAVE0_1, α WAVE0_2, and α WAVE0_3 input to the second waveform signal receivers 30*a* and 30*b* passes through the first and second delay circuits 157 and 158 and then they are supplied as waveform signals WAVE1_1, WAVE1_2, and WAVE1_3; WAVE2_1, WAVE2_2, and WAVE2_3 to multiplexers 14*a* and 16*a* corresponding to magenta (M) and black (Bk), respectively.

The electric construction of the delay circuits 157 and 158 will be described, As illustrated in FIG. 7, each of the delay circuits 157 and 158 has three first input ports A0, A1, and A2; three second input ports B0, B1, and B2; three output ports Y0, Y1, and Y2; a terminal for receiving a clock signal DCLK; and an nA/B terminal and a TAP terminal for receiving signals for determining the outputs from the output ports Y0, Y1, and Y2. The clock signal DCLK and the signals to be input to the nA/B and TAP terminals are supplied from the printed circuit board 28 in the printer body.

The first input ports A0, A1, and A2 are connected to the second waveform signal receivers 30*a* and 30*b*. The second input ports B0, B1, and B2 are connected to the first waveform signal receivers 12*a* and 12*b*. The output ports Y0, Y1, and Y2 are connected to the multiplexers 14*a* and 16*a*. The output ports Y0, Y1, and Y2 of the delay circuits 157 and 158 outputs three waveform signals WAVE1_1, WAVE1_2, and WAVE1_3; WAVE2_1, WAVE2_2, and WAVE2_3, respectively.

FIG. 8 shows logical conditions of outputs of the delay circuits 157 and 158. In nA, A is a negative logic signal. In FIG. 8, "upward arrow" of the clock signal DCLK means that data is sent from the input side to the output side in accordance with the rising edge of the clock signal DCLK. The item "degree of delay" indicates the degree of delay by non-illustrated one or more delay flip-flops provided between each pair of input and output ports of the delay circuits 157 and 158, wherein the degree of delay by one delay flip-flop is considered one As shown in FIG. 8, when the input signal to the nA/B terminal is "0", irrespective of whether the input signal to the TAP terminal is "0" or "1", the output ports Y0, Y1, and Y2 output the signals input to the first input ports A0, A1, and A2, with no delay. When the input signal to the nA/B terminal is "1" and the input signal to the TAP terminal is "0", the degree of delay is two. In this case, the signals input to the second input ports B0, B1, and B2 are delayed by two pulses of the clock signal DCLK by two delay flip-flops, and the output ports Y0, Y1, and Y2 output the delayed signals. When the input signal to the nA/B terminal is "1" and the input signal to the TAP terminal is "1", the degree of delay is four. In this case, the signals input to the second input ports B0, B1, and B2 are delayed by four pulses of the clock signal DCLK by four delay flip-flops, and the output ports Y0, Y1, and Y2 output the delayed signals.

Thus, in accordance with the input signals to the nA/B and TAP terminals, each of the delay circuits 157 and 158 outputs the three waveform signals WAVE0_1, WAVE0_2, and WAVE0_3 received through the first waveform signal receivers 12*a* and 12*b*, after being delayed, or outputs the three waveform signals α WAVE0_1, α WAVE0_2, and α WAVE0_3 received through the second waveform signal receivers 30*a* and 30*b*, with no delay. In addition, the degree of delay of the waveform signals WAVE0_1, WAVE0_2, and WAVE0_3 can be changed in accordance with the input signals to the nA/B and TAP terminals, as shown in FIG. 8.

As described above, in the driving apparatus for a recording head, i.e., the driver IC 111, according to the second embodiment of the present invention, because the delay circuits 157 and 158 are constructed as described above, the construction for generating drive signals DR* on the basis of signals obtained by delaying one set of waveform signals WAVE0_1, WAVE0_2, and WAVE0_3 and the construction for generating drive signals DR* on the basis of the other set of waveform signals α WAVE0_1, α WAVE0_2, and α WAVE0_3 can be united.

In addition, this embodiment is constructed such that the degree of delay can be changed in accordance with the input signals to the nA/B and TAP terminals of the delay circuits 157 and 158, as shown in FIG. 8. Therefore, by controlling the degree of delay to an adequate value, the problems of overcurrent and crosstalk can be relieved more efficiently. Further, even when the driving timings must be controlled in accordance with the shape of waveform signal, for example, the width or height of pulse, it can be easily coped with by changing the degree of delay.

In the driver IC 111 of the second embodiment, even when one or both of the two second waveform signal receivers 30*a* and 30*b* are omitted or not used, the present invention is applicable. In such cases, no signal is input to any of the first input ports A0, A1, and A2 of one or both of the delay circuits 157 and 158. Examples of those cases will be described with reference to FIGS. 9 and 10.

Figure 9:
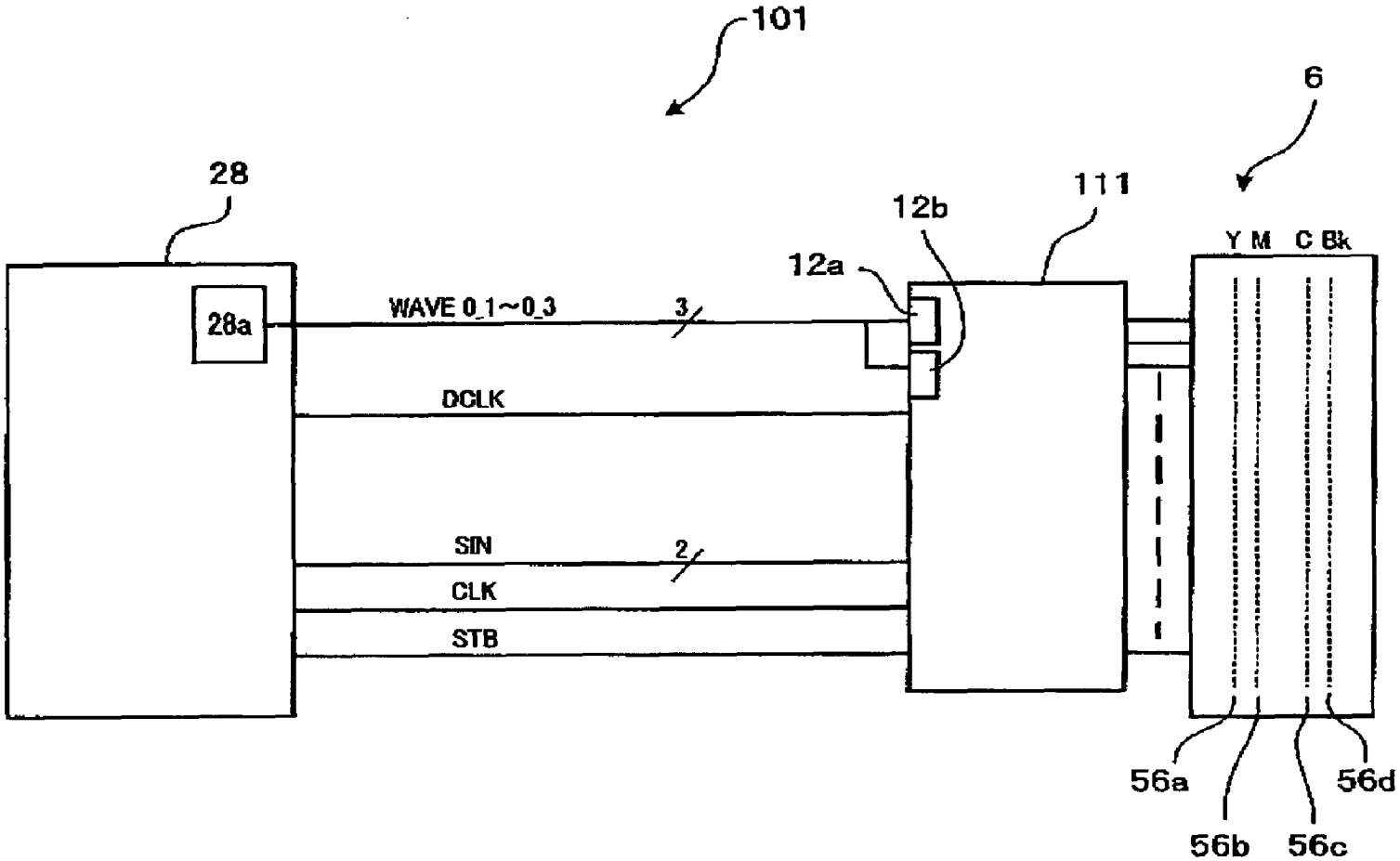
FIG. 9 is a block diagram generally showing the electric construction of an inkjet printer including therein the driver IC according to the second embodiment when both of second waveform signal receivers are not used.

FIG. 9 is a block diagram generally showing the electric construction of an inkjet printer including therein the driver IC 111 according to the second embodiment when both of the second waveform signal receivers 30*a* and 30*b* are not used. This construction is applied to a case wherein the waveform signals to the actuator groups of the respective colors need not be different from one another, for example, a case wherein all color inks are dye inks. In the example of FIG. 9, the waveform signal generator 28*a* of the printed circuit board 28 in the printer body generates only one set of waveform signals WAVE0_1, WAVE0_2, and WAVE0_3, and the other set of waveform signals α WAVE0_1, α WAVE0_2, and α WAVE0_3 as described above are not generated.

In this example, because both the second waveform signal receivers 30*a* and 30*b* as illustrated in FIG. 7 are not used, no signal is input to any of the first input ports A0, A1, and A2 of the delay circuits 157 and 158. Therefore, not the bit signal "0" but the bit signal "1" is input to the nA/B terminal of each of the delay circuits 157 and 158 (see FIG. 8) so that signals obtained by delaying the waveform signals WAVE0_, WAVE0_2, and WAVE0_3 by a predetermined degree are sent to the multiplexers 14*a* and 16*a* corresponding to magenta (M) and black (Bk). In this manner, the actuator groups 60*a* and 60*c* corresponding to yellow (Y) and cyan (C) are driven at the same timing and the actuator groups 60*b* and 60*d* corresponding to magenta (M) and black (Bk) are driven at the timing delayed by the predetermined degree by the delay circuits 157 and 158 from the driving timing of the actuator groups 60*a* and 60*c* corresponding to yellow (Y) and cyan (C).

Figure 10:
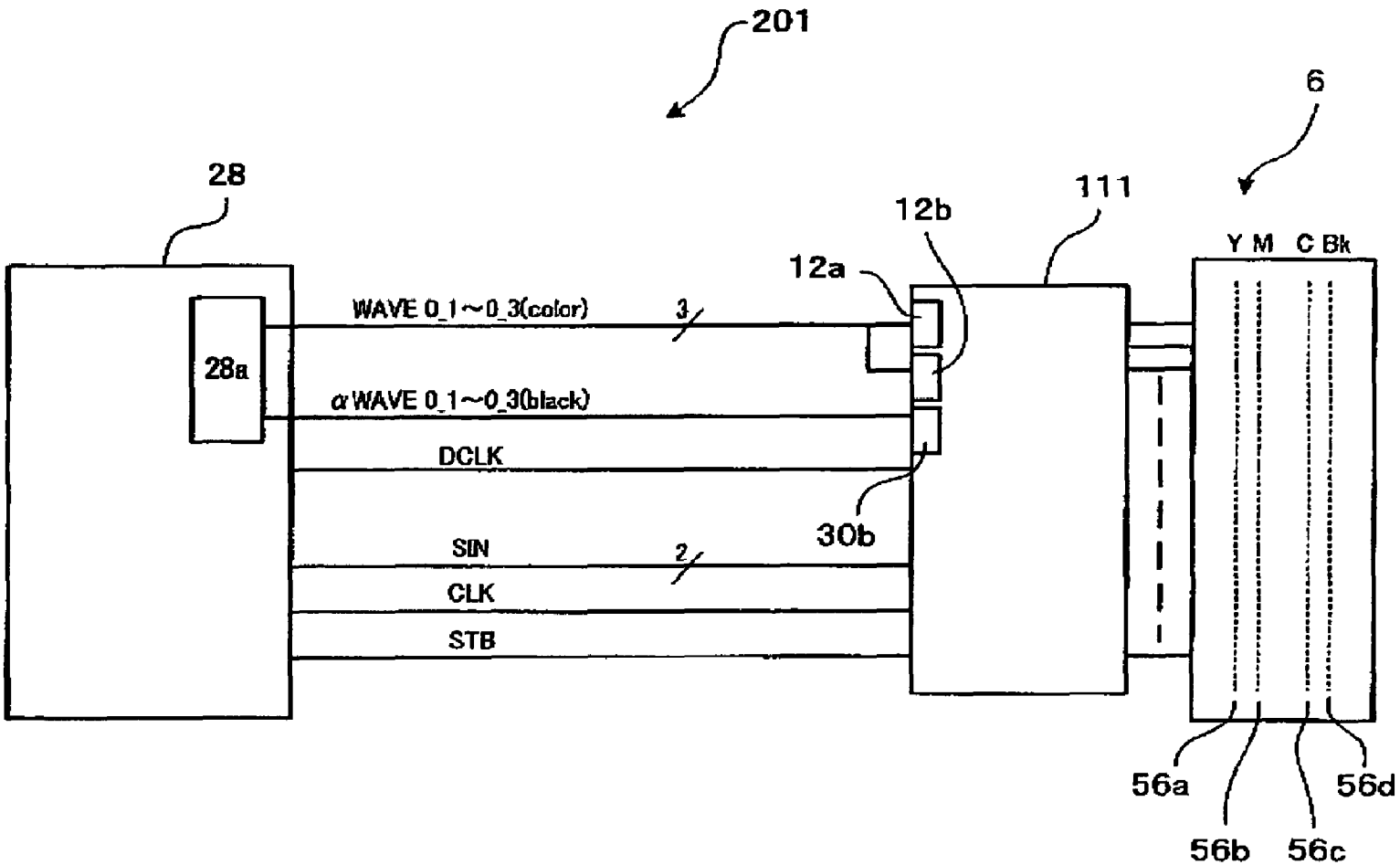
FIG. 10 is a block diagram generally showing the electric construction of an inkjet printer including therein the driver IC according to the second embodiment when one of the second waveform signal receivers is not used.

FIG. 10 is a block diagram generally showing the electric construction of an inkjet printer including therein the driver IC 111 according to the second embodiment when one second waveform signal receiver 30*a* is not used. This construction is applied to a case wherein the waveform signals must be different from one another due to the difference in physical properties, such as viscosity and surface tension, between inks to be used, for example, a case wherein only black ink is pigment ink and the other three inks are dye inks. In the example of FIG. 10, the waveform signal generator 28*a* of the printed circuit board 28 in the printer body generates one set of waveform signals WAVE0_1, WAVE0_2, and WAVE0_3 for three colors other than black and one set of waveform signals α WAVE0__1, α WAVE0_2, and α WAVE0_3 for black.

In this example, because the second waveform signal receiver 30*a* as illustrated in FIG. 7 is not used, no signal is input to any of the first input ports A0, A1, and A2 of the first delay circuit 157. Therefore, not the bit signal "0" but the bit signal "1" is input to the nA/B terminal of the first delay circuit 157 (see FIG. 8) so that signals obtained by delaying the waveform signals WAVE0_1, WAVE0_2, and WAVE0_3 by a predetermined degree are sent to the multiplexer 14*a* corresponding to magenta (M). Further, the bit signal "0" is input to the nA/B terminal of the second delay circuit 158 so that one set of waveform signals α WAVE0__1, α WAVE0_2, and α WAVE0_3 for black are sent to the multiplexer 16*a* corresponding to black (Bk) with no delay. Thus, the actuator groups 60*a*, 60*c*, 60*d* corresponding to yellow (Y), cyan (C), and black (Bk) are driven at the same timing, while the actuator group 60*b* corresponding to magenta (M) is driven at the timing delayed by the predetermined degree by the first delay circuit 157.

As described above with reference to FIGS. 9 and 10, the driver IC 111 of the second embodiment can be used in various forms without changing the internal circuit construction.

In the above-described first and second embodiments, one set of three waveform signals WAVE0_1, WAVE0_2, and WAVE0_3; or α WAVE0_1, α WAVE0_2, and α WAVE0_3 are supplied to each of the actuator groups 60*a* to 60*d*, as illustrated in FIGS. 3 and 7. However, the present invention is not limited to that. For example, one set of four or more waveform signals may be supplied to each of the actuator groups 60*a* to 60*d*. In such a case, however, as the number of waveform signals constituting one set is increased, the number of bits contained in image data, that is, the number of bits of the selection signal SEL*, must be increased accordingly.

In the above-described embodiments, three waveform signals WAVE0_1, WAVE0_2, and WAVE0_3 in one set are distinguished from one another by the number of pulses for one dot, as shown in FIG. 6. By selecting one of them, the total quantity of dropped ink is varied to realize tone control. However, the parameter for distinguishing the waveform signals in one set is not limited to the number of pulses for one dot. The width or height of pulse may be used as such a parameter. For example, if the pulse width is varied, hysteresis control is possible.

In the above-described embodiments, recording elements are classified into groups corresponding to the respective colors, and the combination of each of the nozzle rows 56*a* to 56*d* and the corresponding one of the actuator groups 60*a* to 60*d* is regarded as one recording element group. However, the present invention is not limited to that. For example, the nozzles constituting one nozzle row may be classified into groups.

In the above-described embodiments, a single recording head 6 is used that includes the nozzle rows 56*a* to 56*d* for the respective colors. However, recording heads each corresponding to a single color may be used. Further, the number of colors is not limited to four such as yellow, magenta, cyan, and black. Any number of colors can be used though the number of colors must be two or more. Further, the combination of colors may be various.

In accordance with the number of colors, the circuit construction of the driver IC 11 or 111, more specifically, the number of circuit components, such as the shift registers 20, 21, 22, 23; the delay flip-flops 24, 25, 26, 27; and the drive signal providers 13, 14, 15, 16, may be changed. Further, the number of delay circuits may be changed adequately.

Although the delay circuits 17 to 19 of the first embodiment are connected to each other in series, they may be connected to each other in parallel. Although the delay circuits 157 and 158 of the second embodiment are connected to each other in parallel, they may be connected to each other in series. By connecting delay circuits to each other in series, the problems of overcurrent and crosstalk can be relieved more effectively because waveform signals delayed in order can be supplied to an actuator group corresponding to each color, as described above.

The present invention is not limited to ink-jet printers. For example, the present invention is applicable also to inkjet type facsimiles and copying machines. Further, the present invention is not limited to inkjet type. The present invention is applicable also to thermal transfer type, dot impact type, and dot matrix type.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A driving apparatus for at least one recording head, the apparatus comprising:

a first waveform signal receiver that receives, through signal lines, a plurality of waveform signals representing various recording modes;

a first drive signal provider that generates drive signals on the basis of the plurality of waveform signals received by the first waveform signal receiver, and supplies the drive signals to one of recording element groups included in the at least one recording head:

a first delay circuit that delays the waveform signals received by the first waveform signal receiver; and a second drive signal provider that generates drive signals on the basis of the waveform signals delayed by the first delay circuit, and supplies the drive signals to another recording element group;

wherein the apparatus further comprises a second waveform signal receiver that receives, through signal lines, a plurality of waveform signals representing various recording modes; and wherein the first delay circuit selectively outputs, to the second drive signal provider, either the waveform signals obtained by delaying the waveform signals received by the first waveform signal receiver or the waveform signals received by the second waveform signal receiver.

2. The driving apparatus according to claim 1, wherein the number of recording element groups is N that is a a natural number of two or more, and the apparatus comprises:

(N-1) delay circuits, including the first delay circuit, connected to each other in series, each of the delay circuits sequentially delays the waveform signals delayed by the first delay circuit; and N drive signal providers, including the first and second drive signal providers, each of which generates drive signals on the basis of either the plurality of waveform signals received by the first waveform signal receiver or the waveform signals delayed by a corresponding one of the (N-1) delay circuits, and supplies the drive signals to a corresponding one of the recording element groups.

3. The driving apparatus according to claim 1, wherein the number of recoding element groups is N that is a natural number of three or more, and the apparatus further comprises:

second to (N-1)th delay circuits connected to the first delay circuit, the second to (N-1)th delay circuits further delaying the waveform signals delayed by the first delay circuit; and third to N-th drive signal providers each of which generates drive signals on the basis of the waveform signals delayed by a corresponding one of the (N-2) delay circuits, and supplies the drive signals to another recording element group.

4. The driving apparatus according to claim 3, wherein N is four or more and the second to (N-1)th delay circuits are connected to each other in series.

5. The driving apparatus according to claim 1, wherein the degree of delay of the waveform signals y the first delay circuit is changeable.

6. The driving apparatus according to claim 1, wherein each of the first and the second drive signal providers receives image data for recording elements of a corresponding one of the recording element groups, and selects one of the plurality of waveform signals on the basis of the image data so as to generate and supply a drive signal to each of the recording elements of the corresponding group.

7. The driving apparatus according to claim 1, wherein each of the plurality of waveform signals is for forming one dot, and the waveform signals differ from each other in at least one of the number of pulses, pulse width, and pulse height.

8. The driving apparatus according to claim 1, wherein each of the plurality of waveform signals is for forming one dot, and dots formed from the plurality of waveform signals are different from each other in tone.

9. An image recording apparatus comprising:

a waveform signal generator that generates a plurality of waveform signals representing various recording modes;

at least one recording head including a plurality of recording element groups; and a driving apparatus that drives the at least one recording head;

the driving apparatus comprising:

a first waveform signal receiver that receives, through signal lines, the plurality of waveform signals generated by the waveform signal generator;

a first drive signal provider that generates drive signals on the basis of the plurality of waveform signals received by the first waveform signal receiver, and supplies the drive signals to one of recording element groups included in the at least one recording head:

a first delay circuit that delays the waveform signals received by the first waveform signal receiver; and a second drive signal provider that generates drive signals on the basis of the waveform signals delayed by the first delay circuit, and supplies the drive signals to another recording element group;

wherein the driving apparatus further comprises a second waveform signal receiver that receives, through signal lines, a plurality of waveform signals representing various recording modes; and wherein the first delay circuit selectively outputs, to the second drive signal provider, either the waveform signals obtained by delaying the waveform signals received by the first waveform signal receiver or the waveform signals received by the second waveform signal receiver.

10. The image recording apparatus according to claim 9, further comprising:

an image data generator that outputs, to each of the first and the second drive signal providers, image data for recording elements of corresponding one of the recording element groups, wherein each of he first and the second drive signal providers selects one of the plurality of waveform signals on the basis of the image data so as to generate and supply a drive signal to each of the recording elements of the corresponding group.

11. The image recording apparatus according to claim 9, wherein the waveform signal generator generates the plurality of waveform signals repeatedly in constant printing cycles.

* * * * *